United States Patent [19]

Greenberg

[11] Patent Number: 4,565,499

[45] Date of Patent: Jan. 21, 1986

[54] EJECTOR

[76] Inventor: Dan Greenberg, 4 Rehov Haganim, Kiryat Bialik, Israel

[21] Appl. No.: 602,374

[22] Filed: Apr. 20, 1984

[30] Foreign Application Priority Data

Nov. 15, 1983 [IL] Israel ..... 70239

[51] Int. Cl.[4] ..... F04F 5/00

[52] U.S. Cl. ..... 417/174; 29/156.4 R; 417/196

[58] Field of Search ..... 417/174, 196, 198, 151, 417/167; 29/156.4 R

[56] References Cited

U.S. PATENT DOCUMENTS

| | | | |
|---|---|---|---|
| 1,647,402 | 11/1927 | Eynon | 417/174 X |
| 3,022,743 | 2/1962 | Engholdt | 103/258 |
| 3,106,431 | 10/1963 | Hartley | 308/5 |
| 3,146,726 | 9/1964 | Sidebottom | 417/198 |
| 3,331,117 | 7/1967 | Jacobellis | 29/157 |
| 3,334,401 | 8/1967 | Hoplinson, Jr. | 29/157 |
| 3,527,502 | 9/1970 | Graham | 302/42 |
| 3,541,657 | 11/1970 | Ellingsen | 29/157.1 |
| 3,795,348 | 3/1974 | Vertue | 222/193 |
| 3,916,960 | 11/1975 | Thompson | 141/1 |
| 3,959,864 | 6/1976 | Tell | 417/174 |
| 4,395,202 | 7/1983 | Tell | 417/174 |
| 4,466,778 | 8/1984 | Volkmann | 417/174 |

FOREIGN PATENT DOCUMENTS

| | | | |
|---|---|---|---|
| 138500 | 10/1981 | Japan | 406/153 |

*Primary Examiner*—Edward K. Look

*Attorney, Agent, or Firm*—Renner, Otto, Boisselle & Lyon

[57] ABSTRACT

An ejector device having large evacuation capacity comprises a cylindrical body the cylinder face of which is subdivided into ring shaped chambers which extend around and are partitioned off from an empty space at the center of the cylinder. The said chambers are interconnected in succession to one another by ejector nozzles seated co-axially to one another in the partitions between the chambers. There is also provided an inlet into the device for a pressure medium and an outlet from one of the chambers. The cylinder is inserted into a sleeve which tightly encloses it and closes the chambers.

12 Claims, 3 Drawing Figures

EJECTOR

FIELD OF THE INVENTION

The present invention relates to a new construction of an ejector device and a method for producing same, and more particularly to such devices which can be assembled to from a set by means of which pressurized air is made to pass therein in succession from one ejector nozzle to a subsequent one; whereby the assembly of devices has a large evacuation capacity in combination with a maximal negative pressure.

There are known a number of such ejector devices, e.g. the one described in U.S. Pat. No. 3,959,864. The advantages of the method described in that patent specification are apparent, but nevertheless there are still some disadvantages in the device according to that patent.

To overcome these disadvantages, there are already been suggested in my Israeli Patent Application No. 67012 a new method for producing such an ejector device. One of the objects of the invention described in said patent application was to provide a modular ejector device which can be duplicated or triplicated when a greater evacuation capacity is needed. However, practice showed that after adding more than four units the evacuation capacity is not increasing as expected which is due to the limited size of the evacuation inlet of the third and fourth units. Moreover in some cases when a great evacuation capacity is needed thus requiring a number of units, the space which is needed for such ejector is large and not available.

OBJECTS OF THE INVENTION

It is thus the object of the present invention to overcome these disadvantages, i.e. to provide a device and method for producing an ejector device which on the one hand will have a great evacuation capacity and which will be of relatively small size on the other. Moreover the evacuation inlet will be of sufficient size with the option of enlarging same if needed.

SHORT SUMMARY OF THE INVENTION

The invention is characterised by a novel cylindrical configuration of the device which—due to this shape—is capable of withstanding greater pressure or sub-pressure and a method for producing an ejector device which comprises a cylinder the wall of which is hollow and of considerable thickness around a central empty space, and the inner space of which hollow wall is subdivided into ring shaped chambers by partitions extending across the axis of the cylinder the said ring shaped chambers constituting the suction chambers, an inlet opening for a pressure medium and several ejector nozzles being positioned co-axially one after the other in the successive suction chambers, one of said chambers being provided with an outlet for the pressure medium while another of said chambers is connected with the said central space in the cylinder. The method for producing this device comprises the steps of producing the thick walled cylinder, forming in its outer cylindrical surface said suction chambers, forming communication openings between every two successive ones of said suction chambers, drilling holes through the partitions separating suction chambers from one another for accommodation of nozzles, inserting ejector nozzles into said holes with valve flaps to cover communication openings in said partitions and thereafter enclosing the said cylinder in a sleeve and providing appropriate seals between the partition walls and the said sleeve and closing one side of the empty space at the centre of the cylinder.

SHORT DESCRIPTION OF DRAWINGS

The invention will now be described in detail, referring to the annexed drawings in which:

FIG. 1 is a perspective view of an example of an ejector according to the invention, while

Figure 1:
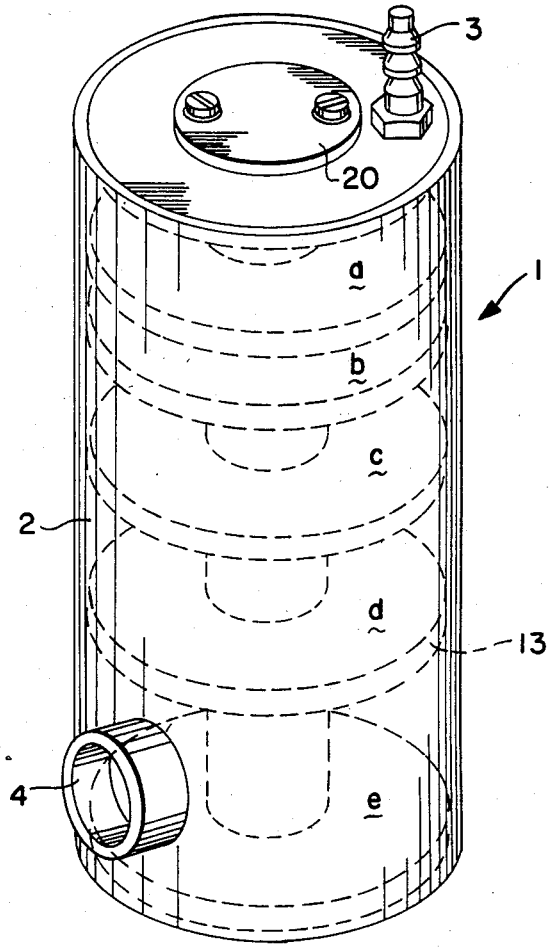
Figure 2:
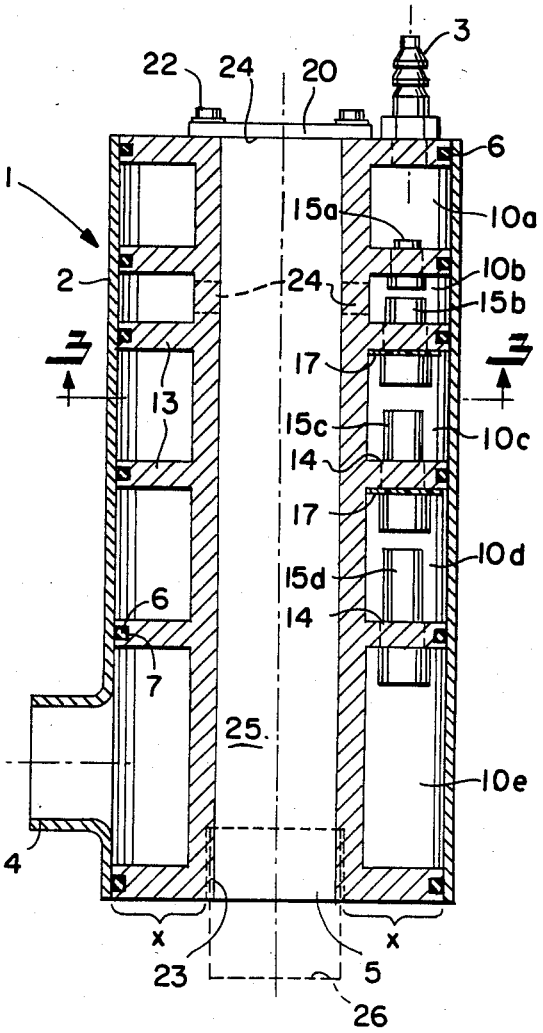
FIG. 2 is an axial cross-sectional view of the ejector.

Turning first to FIG. 1 and 2, the new ejector comprises a cylinder designated as a whole by numeral 1. The device shown includes a number of integrally connected ring shaped chambers designated by letters a, b, c, d, e which cylinder is placed in a sleeve 2. There is provided an inlet 3 for pressure medium leading into chamber a and an outlet 4 from chamber d for said medium and an evacuation inlet port 5. As can be seen in FIG. 2 the device constitutes a cylindrical body 1 the wall of which is of a considerable thickness (X). By known means (such as electroerosion) ring shaped chambers 10*a*, 10*b*, 10*c*, 10*d* are provided within said wall.

Figure 3:
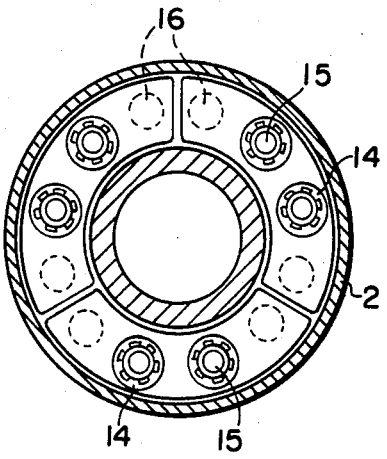
FIG. 3 is a cross-sectional view along line III—III of the ejector shown in FIG. 1.

Prior to introducing the cylinder 1 into sleeve 2 "0" rings 6 are placed within circumferential grooves 7 which are provided on horizontal partitions 13 separating and sealing chambers 10 from one another. In said partitions 13, holes 14 are provided in which nozzles 15 are co-axially fixedly inserted. Further holes 16 (see FIG. 3) are provided in partitions 13 which are covered by plastic flaps 17 at one side of the partition, thus permitting passage of air or gas in one direction only. The flaps 17 are held in position by means of the bodies of nozzles 15. The chambers 10 are subject to different sub-pressure values as will be explained. One end of cylinder 1 is closed by means of plate member 20 and a seal 21, said plate member 20 is attached to the housing 1 by means of screw bolts 22 while the second end is provided with a screw thread 23 into which the evacuation pipe 26 is fitted.

The ejector so far described operates in the following way:

Inlet 3 is connected to a source of pressurized air, say a compressor. Pressurized air (or another fluid) is pressed into chamber 10*a*, it will flow out through the nozzle 15*a* into chamber 10*b* and through nozzle 15*b* into chamber 10*c* and so on. At its passage through a chamber the air stream will take along air from that chamber, so that the initial pressurized air together with the air brought with it all will flow out through the outlet 4. Thus the quantity of air will increase through the nozzles from chamber to chamber, consequently the sub-pressure in the chambers will successively increase. When the sub-pressure in chamber 10*d* is lower than chamber 10*c*, air will flow from chamber 10*c* to chamber 10*d* through hole 16, the sub-pressure in chamber 10*c* will cause air flow from chamber 10*b*. The only way into chamber 15*b* is through hole 24 which establishes communication between chamber 15*b* and the space 25 within the cylinder 1 which has the inlet 5, i.e. said inlet acts as a suction inlet.

As can be seen in FIG. 2, the distance between co-axial nozzles increases in the direction of flow and so does the diameter of the individual nozzles, a matter which is subject to the efficiency degree to be obtained.

The advantages of the new device are obvious:

1. The circular shape of the device—and consequently of the individual chambers—renders it better adapted to withstand pressure which means that the device could be of lighter weight.

2. The round shape is easier to process by turning, electro-erosion and also in the case of casting the cylinder.

3. Greater adaptability to individual uses since there may be provided two nozzles and two valves as e.g. in FIG. 3, or in other words the range of uses of a device could be much broader than is the case with conventional devices.

I claim:

1. An ejector device comprising a number of suction chambers which are interconnected by ejector nozzles characterised thereby that the assembly of suction chambers constitutes a cylinder the wall of which is of considerable thickness around a central empty space, and which wall is subdivided into ring shaped chambers by partitions extending across the axis of the cylinder, the said ring shaped chambers constituting the suction chambers, an inlet opening for a pressure medium being provided and leading into that one of the suction chambers which is at one end of the cylinder, several ejector nozzles being positioned co-axially one after the other in the successive suction chambers, one of said chambers being provided with an outlet for the pressure medium while another of said chambers is connected with the inner space of the cylinder, there being further provided apertures in the said partitions, such apertures being covered on one side of the partition by flaps, so as to permit passage of air from one suction chamber into the next one in one direction only, and said flaps extending across said nozzles and being held in position by the bodies of said nozzles.

2. The ejector device claimed in claim 1, characterised thereby that the assembly of ring shaped chambers is held in a cylindrical sleeve.

3. The ejector device claimed in claim 2, characterised thereby that circumferential grooves are provided in the outer edge of each partition in which grooves O-rings are seated.

4. An ejector device comprising a cylindrical wall forming an interior open space, annular partition walls axially spaced along and extending radially outwardly from said cylindrical wall to form plural ring-shaped ejector chambers, means for closing radially outer sides of said ejector chambers, plural ejector nozzles positioned coaxially in respective partition walls separating relatively adjacent ejector chambers for interconnecting such chambers, plural one-way valve means in respective partition walls separating relatively adjacent chambers to permit passage of air between such chambers in one direction only, a pressure medium inlet and a pressure medium outlet in communication with respective different ejector chambers, and a suction inlet connecting one of said ejector chambers to said interior open space.

5. An ejector device as set forth in claim 4, wherein each one-way valve means includes an aperture in the respective partition wall covered on one side of the partition wall by a respective flap.

6. An ejector device as set forth in claim 4, wherein said cylindrical wall and partition walls are an integral part of a thick-walled cylindrical body, and said ejector chambers are formed in the outer cylindrical surface of said thick-walled body.

7. An ejector device as set forth in claim 4, wherein said means for closing includes a cylindrical sleeve.

8. An ejector device as set forth in claim 7, wherein each partition wall has an annular groove in its outer peripheral edge, and further comprising an O-ring seated in each groove for sealing the respective partition wall to the inner diameter of said cylindrical sleeve.

9. An ejector device as set forth in claim 4, wherein at least two ejector nozzles are positioned in a respective partition wall in coaxial alignment wih corresponding nozzles in the other partition walls.

10. A method of making an ejector device comprising the steps of forming in the outer cylindrical surface of a thick-walled hollow cylinder a plurality of axially successive, ring-shaped ejector chambers with respective transverse annular partition wall portions of the cylinder separating relatively adjacent ejector chambers, forming communication openings in the transverse partition wall portions between adjacent chambers, drilling co-axial holes through the transverse partition wall portions between adjacent chambers for accommodation of ejector nozzles, inserting ejector nozzles into the holes in respective transverse partition wall portions, installing valve flaps to cover respective communication openings, and closing the radially outer sides of the ejector chambers by securing and sealing a cylindrical sleeve to the outer peripheral edges of the transverse partition wall portions.

11. A method as set forth in claim 10, wherein the ejector chambers are formed in the cylinder by subjecting the later to an electro-erosion process.

12. A method as set forth in claim 10, further comprising the step of closing one end of the interior space at the center of the cylinder.

* * * * *